US006851154B1

(12) United States Patent
Neff

(10) Patent No.: US 6,851,154 B1
(45) Date of Patent: Feb. 8, 2005

(54) DEVICE FOR APPLYING SUBSTANCES TO A BODY

(76) Inventor: Virginia Lynn Neff, 1661 E. Nichole Cir., Sandy, UT (US) 84093

( * ) Notice: Subject to any disclaimer, the term of this patent is extended or adjusted under 35 U.S.C. 154(b) by 62 days.

(21) Appl. No.: 09/957,994

(22) Filed: Sep. 21, 2001

(51) Int. Cl.[7] ..... A47K 7/02
(52) U.S. Cl. ..... 15/222; 15/209.1; 401/8
(58) Field of Search ..... 15/222, 210.1, 15/209.1

(56) References Cited

U.S. PATENT DOCUMENTS 1,379,925 A * 5/1921 Kawasaki ..... 15/222
3,072,946 A * 1/1963 Falce ..... 15/222
3,213,474 A * 10/1965 Toth ..... 15/222
3,812,849 A 5/1974 Giunta
3,959,841 A 6/1976 Horne
4,759,652 A 7/1988 Ulrich
5,035,523 A 7/1991 Allinder
5,386,609 A * 2/1995 Xenos ..... 15/222
6,003,190 A * 12/1999 Knudsen ..... 15/210.1
6,006,761 A * 12/1999 Meledandri ..... 132/320
6,012,195 A * 1/2000 Lindsay ..... 15/222
6,616,364 B2 * 9/2003 Katz et al. ..... 401/6

* cited by examiner

*Primary Examiner*—Terrence R. Till
*Assistant Examiner*—S Balsis
(74) *Attorney, Agent, or Firm*—Morriss O'Bryant Compagni, P.C.

(57) ABSTRACT

A device substances, such as medications or lotions, to difficult-to-reach places of the body provides a washable applicator member having a defined thickness comprising a first layer of material and a second layer of material which is formed, at least in part, non-absorbent and preferably water repellent material. The second layer of the applicator member is also structured with an absorbent layer providing a contact surface for applying substances to the body. Elasticized extension members secured to the applicator member and attached handles allow the device to be used without straining the muscles of the arms or shoulders.

17 Claims, 1 Drawing Sheet

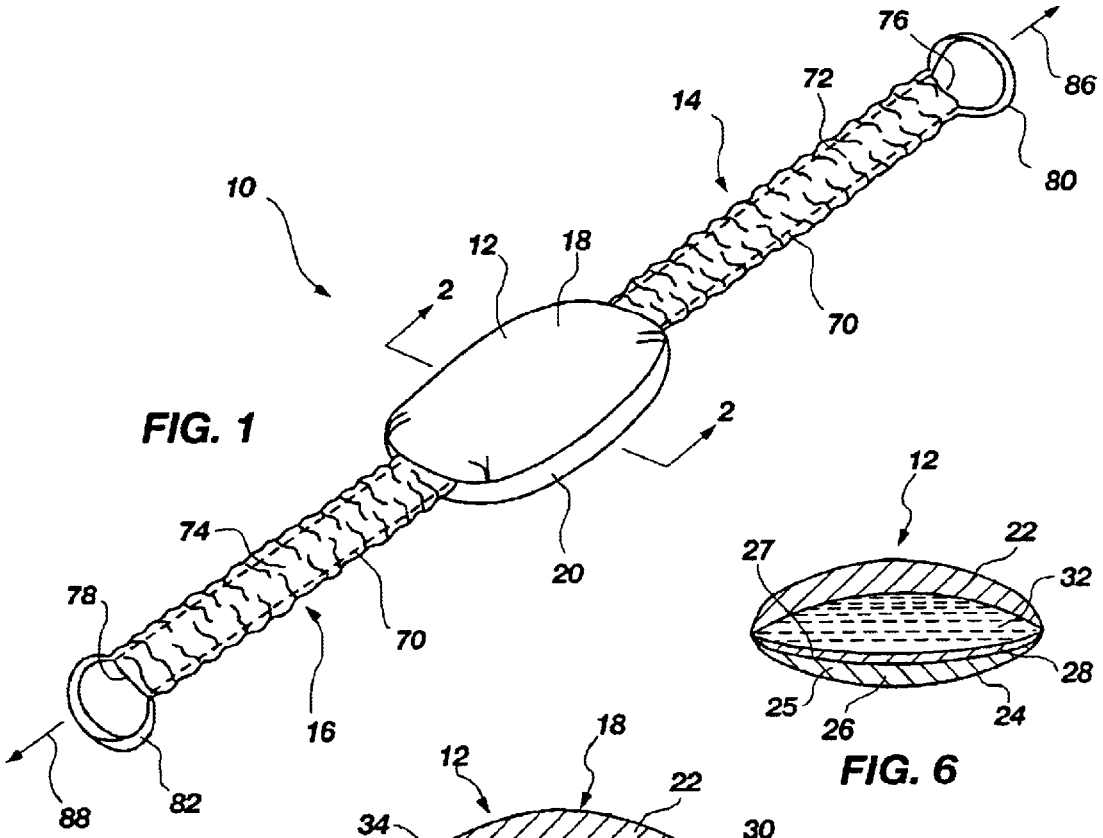
FIG. 1
FIG. 6
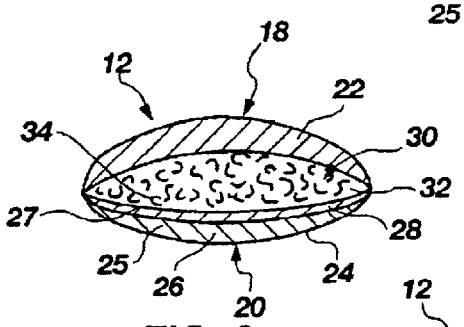
FIG. 2
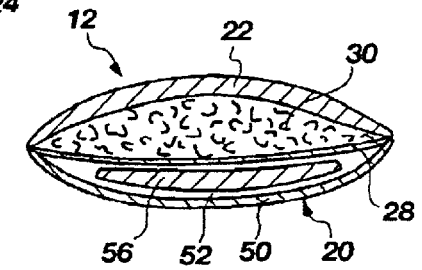
FIG. 4
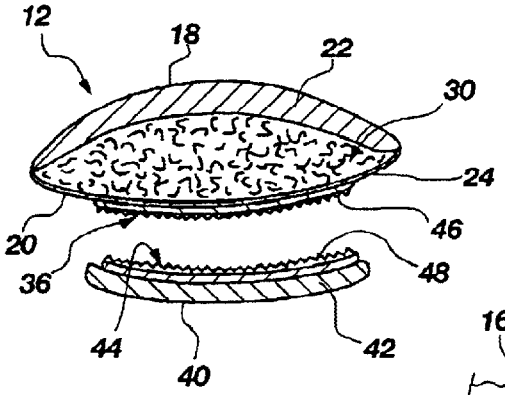
FIG. 3
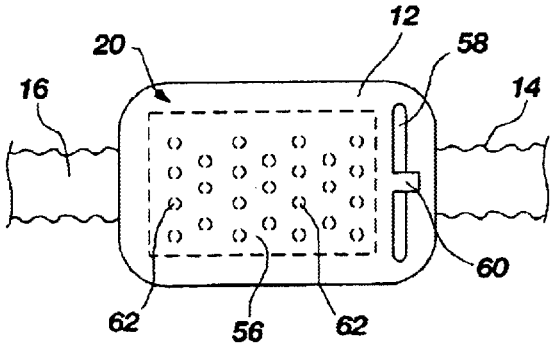
FIG. 5

DEVICE FOR APPLYING SUBSTANCES TO A BODY

BACKGROUND OF THE INVENTION

1. Field of the Invention

This invention relates to means and devices for applying substances, such as lotion, to a human body and specifically relates to devices structured to enable a user of the device to apply substances to his or her own body, particularly the back.

2. Description of the Related Art

Many people apply lotion to those parts of their bodies where the skin becomes dry, rough or abraded due to exposure to harmful conditions. Most typically, people apply lotion to their hands, feet, elbows and knees, which are known to be particularly subject to roughened condition. However, other parts of the body can become dry, chaffed or irritated and may benefit by the application of a medicinal preparation or moisturizing agent in a spreadable topical form.

One area which presents a problem with respect to the application of a medicinal agent or lotion is the back. Only the most agile person may be able to reach his or her back without assistance of some kind. Therefore, some means or device for reaching the back to apply lotion would be advantageous. Such a device may also be useful in reaching other parts of the body more readily accessible to the average person, but inaccessible to some people due to medical condition, infirmity or lack of flexibility.

Devices for applying lotions, oils or other agents to the back have been described in the prior art. For example, U.S. Pat. No. 3,959,841 to Horne describes an elongated length of inelastic material having a pocket formed in the middle of the length for receiving a disposable pad infiltrated with an applicable preparation. U.S. Pat. No. 3,812,849 to Guinta discloses an elongated length of inelastic material which is folded in a length-wise manner to provide an elongated fold into which a bar of soap may be placed for washing the back. U.S. Pat. No. 4,759,652 to Ulrich discloses a disposable strip of inelastic material which is dispensed from a container filled with a medicament or other agent. U.S. Pat. No. 5,035,523 to Allinder discloses a belt sized to fit about the waist which is further structured with, among other features, a removable pad that can be used to apply lotions or other materials to the back. U.S. Pat. No. 6,012,195 to Lindsay discloses a glove-like pouch sized to fit on a hand for applying soaps or lotions, and further discloses detachable, inelastic straps attachable to the pouch to enable applying substances to the back.

The devices described above each have one or more unfavorable features, or lack an advantageous feature, which render the device unsuitable in some respect for use as an applicator device. For example, many devices are of fixed length because they have inelastic straps, and as a result, the arms and shoulders of the user become strained trying to use a device which is too short in length. Other devices lack handles at the end of the straps, which can cause the user to lose his or her grip on the device while in use. In the case of U.S. Pat. No. 6,012,195, the attachable straps expose the user to sharp hooks and/or provide a device where the straps can inadvertently become detached from the applicator during use. None of the devices described provide a structure which contains the spread of the lotion or other agent to that portion of the device which contacts the skin, and known devices are, therefore, messy to use.

Thus, it would be advantageous in the art to provide a device for applying substances to the back, and other difficult-to-reach places of the body, which is structured to be comfortable to use, i.e., without straining the arm or shoulder muscles, and which is structured to localize the applicable substance to that area of the device which is formed to contact the skin.

BRIEF SUMMARY OF THE INVENTION

In accordance with the present invention, a device is provided for applying a substance to difficult-to-reach places of a body, such as the back, which is structured to be adjustable in length to facilitate use of the device and which is structured to localize the applicable substance to an area of the device which is oriented for contact with the skin. Although the present invention may be used to apply any number of substances, such as medications, oils, lotions, or other spreadable agents, the invention is described herein with respect to the application of lotion as merely one exemplar agent of application.

The present invention generally comprises an applicator member to which are securely attached elasticized extension members which enable the user to position the applicator member in contact with the back, or other difficult-to-reach place of the body, and apply lotion without straining the muscles of the arms and shoulders.

The applicator member, in a first embodiment, comprises a pad of selected thickness which comprises a first surface positioned to be oriented away from the body when applying lotion and a second surface positioned to contact the body when applying lotion. The applicator member may also comprise a middle portion positioned between the first surface and second surface to provide a cushioned effect to the applicator member.

The first surface of the applicator member comprises a layer of material which may, most suitably, be a soft, washable material. Alternatively, the layer of material may be made of a fabric or other material which is mildly abrasive to provide exfoliation of the body prior to application of lotion.

The second surface of the applicator member comprises a layer of material which is attached to the layer of material of the first surface and is, most suitably, formed from a porous and/or absorbent material to or through which lotion may be applied for contacting with the skin. In a particularly suitable embodiment, the second surface may be formed from a material which is structured with a first absorbent face and a second or opposing non-absorbent and water repellant face. Accordingly, lotion applied to the absorbent face will not exit through the other side of the material, thereby localizing the lotion to that surface which is oriented to contact the skin. Alternatively, the second surface of the applicator member may be comprised of a first absorbent sub-layer and a second non-absorbent and water repellent sub-layer connected to the first absorbent sub-layer, the second non-absorbent layer being oriented toward the middle portion of the applicator member.

In yet another embodiment of the present invention, the applicator member may be structured with securement apparatus which enables a separate disposable or reusable applicator pad to be detachably attached to the applicator member, thereby enabling the user to apply lotion via the applicator pad and then remove the applicator pad for disposal or cleaning for reuse.

In still another embodiment of the invention, the applicator member may be configured with a pocket formed in or along the second surface of the applicator member. The pocket is sized to receive a disposable prepackaged packet of lotion which delivers lotion through the second surface of the applicator member to the skin.

The middle portion of the applicator member of the invention provides a cushioning effect to the device and may be any suitable substance or material which provides cushioning between the first surface and second surface of the applicator member. For example, the middle portion may comprise an amount of padding material, such as batting or fiberfill, or the middle portion may comprise a quantum of fluid, such as gas or a liquid.

To the applicator member is attached, in substantially opposing orientation, two elongated, elasticized straps which provide stretch in a direction away from the applicator member. Each elasticized strap has a first end which is secured to the applicator member and a second, free end for grasping by the user. A handle is provided at the terminus of the second end of each elasticized strap, thereby enabling secure grasping of the device by the user. In a particularly suitable embodiment, the elasticized straps are covered with a soft, washable material which may be of the same material or fabric as the first surface of the applicator member. The fabric types or characteristics may vary, however.

The elasticized straps are preferably formed from elasticized material, the modulus of elasticity of which allows the elasticized straps to be stretched to a maximum length of a person's wingspan (i.e., arms stretched out straight from and at the height of the shoulders). The elasticized straps, however, may be sized in length to provide a maximum stretch length which is up to thirty percent less than a person's wingspan.

The device of the present invention is constructed to be washable and reusable. The device is also constructed to localize the spread of lotion to that surface of the device which is formed for contact with the skin, and the device is further structured to be adjustable in length to enable persons of different agility, flexibility or reach to engage the device with hard-to-reach areas of the body. These and other advantages of the present invention over known devices will be apparent from the following detailed description of the invention.

BRIEF DESCRIPTION OF THE SEVERAL VIEWS OF THE DRAWINGS

In the drawings, which illustrate what is currently considered to be the best mode for carrying out the invention:

FIG. 1 is a perspective view of the present invention, certain elements being shown in phantom;

FIG. 2 is a view in cross section of the invention shown in FIG. 1, taken at line 2—2;

FIG. 3 is a view in cross section of an alternative embodiment of the invention;

FIG. 4 is a view in cross section of another alternative embodiment of the invention; and FIG. 5 is a partial plan view of the applicator member of the embodiment of the invention shown in FIG. 4, certain elements being shown in phantom.

FIG. 6 is a view in cross section of the present invention where the void filed with fluid.

DETAILED DESCRIPTION OF THE INVENTION

The general elements of the device of the present invention are shown in FIG. 1. The device 10 generally comprises an applicator member 12 and elongated, elasticized straps 14, 16 secured thereto. The applicator member 12 is in the form of a pad having a defined thickness. The applicator member 12 has a first surface 18 which is generally oriented away from the skin when the device is being used to apply lotion. The applicator member 12 also has a second surface 20 which is oriented to contact the skin when the device is used to apply lotion.

As can be seen more readily in FIG. 2, the applicator member 12 is more specifically comprised of a first layer 22 formed from a material which is most suitably soft to the touch and pliant. The material of the first layer 22 may be any suitable fabric which is washable. In an alternative embodiment, the first layer 22 may be made of a washable material that has a nap or slight abrasive character so that the first surface 18 of the device 10 may be used to exfoliate skin from the back or other regions of the body.

The applicator member 12 further comprises a second layer 24 which is attached to and in opposing orientation to the first surface 22. The second layer 24 is formed, most suitably, of a material or fabric which, at least in part, is porous, absorbent and washable. A particularly suitable material may be one which is integrally structured with a first face 25 (FIG. 2) which is porous and absorbent and a second face 27 which is non-absorbent and preferably water repellent. However, it is equally as suitable for the second layer 24 of the applicator member 12 to be formed of a first sub-layer 26 of absorbent, porous material and a separate or non-integrally formed second sub-layer 28 of non-absorbent and preferably water-repellent material.

The applicator member 12 further comprises a middle portion 30 which is structured to provide a cushion between the first surface 18 and second surface 20 of the applicator member 12. The middle portion 30 may, for example, comprise a space or void 32 formed by the conjoining of the first layer 22 and second layer 24 of the applicator member 12. The void 32 may then be filled with any suitable cushioning material or substance, such as, for example, batting 34, as shown in FIG. 2, or a fluid, such as a gas or liquid. The gas or liquid may be contained in a soft packet insertable within the void 32. The middle portion 30 is positioned adjacent the non-absorbent second face 27 or second sub-layer 28, which shields the middle portion 30 from exposure to the lotion applied to the second surface 20 of the applicator member 12.

In an alternative embodiment of the invention shown in FIG. 3, the applicator member 12 may be formed with a first layer 22 of soft, washable material and a middle portion 30 as previously described. However, the second layer 24 comprises a layer of non-absorbent and preferably water repellent material. A securement structure 36 is positioned along the second surface 20 of the applicator member 12 for securing thereto a detachable applicator pad 40. The detachable applicator pad 40 may be formed of an absorbent material layer 42 to which lotion, or another substance, is applied for contact with the skin. The material layer 42 may be a washable material or fabric.

The applicator pad 40 is also provided with securement structure 44 for securing the applicator pad 40 to the second surface 20 of the applicator member 12. Any suitable securement structure may be used to fasten the applicator pad 40 to the applicator member 12, but by way of example only, interlocking hook and loop material 46, 48 is shown as a type of securement structure that may be used. Many other devices, mechanisms or structures may be equally as suitable for use.

Thus, in use, the applicator pad 40 is attached to the second surface 20 of the applicator member 12 and lotion is applied to the absorbent material layer 42 of the applicator pad 40. Once the lotion has been applied to the body, the applicator pad 40 may be removed from the applicator member 12 and disposed of or washed for a subsequent use.

In yet another alternative embodiment of the invention shown in FIGS. 4 and 5, the applicator member 12 may be formed with a first layer 22 and a middle portion 30 as previously described, but the second layer 24 is comprised of a non-absorbent layer 28 positioned adjacent to the middle portion 30 and an outer-facing, porous layer 50. A pocket 52 is formed between the non-absorbent layer 28 and the outer porous layer 50. The pocket 52 is sized to receive a prepackaged packet 56 of dispensable lotion, as shown more clearly in FIG. 5.

As shown in FIG. 5, the applicator member 12 may be formed with an opening 58, preferably having a closure mechanism 60 to retain the opening 58 in a closed position. The opening 58 may be formed in any number of places or positions in the applicator member 12, but is shown in FIG. 5, for example, as being a slit formed at one end of the applicator member 12 along the second surface 20 thereof. The packet 56 of lotion, shown in phantom, may be structured with a plurality of holes 62 which are sized to dispense a selected amount of lotion through the holes upon the application of pressure to the packet 56. The holes 62 are oriented toward the porous layer 50 of the applicator member 12 so that the lotion dispensed from the holes extends through the material of the porous layer 50 and delivers an amount of lotion to the second surface 20 of the applicator member 12 for contacting with the skin.

Referring again to FIG. 1, the device 10 of the present invention further includes two elasticized straps 14, 16 which are secured to the applicator member 12 in any suitable manner. As shown, the straps 14, 16 may be sewn to the applicator member 12 and may be incorporated with the first layer 22 and second layer 24 of the applicator member 12. The elasticized straps 14, 16 may, most suitably, be formed from elastic material 70, shown in phantom, over which is positioned a casing 72, 74 of soft, washable material. The casing 72, 74 material may be the same as the material from with the first layer 22 of the applicator member 12 is formed.

At the terminal end 76, 78 of each strap 14, 16 is positioned a handle 80, 82 which may be formed as a loop of material that the user can firmly grasp in the hand. The handles 80, 82 enable the user to be able to manipulate the applicator member 12 into place on, for example, the back without losing a grip on the device. Further, the elasticized straps 14, 16 stretch in the direction of arrows 86 and 88 to enable the user to easily position and use the device 10 on the back or other difficult-to-reach place of the body without straining muscles.

The device of the present invention 10 may be constructed in any suitable manner. By way of example only, the first layer 22 and second layer 24 may be formed as two equally-sized portions of material which are stitched together around their periphery, once the elasticized straps have been positioned between the first layer 22 and second layer 24 in opposing orientation to each other, as shown. Many other suitable manners and means of construction may be employed.

The present invention is structured to provide an applicator member for applying a lotion or other substance to difficult-to-reach portions of the-body. The elements and features of the invention are described herein with respect to attaining those objectives. However, the basic structure of the invention may be modified to carry out those objectives. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A device for applying substances to difficult-to-reach places of a human body, comprising:

an applicator member formed of washable material and sized for applying substances to extensive and hard-to-reach areas of a body, having a defined thickness and opposing ends;

a first layer of said applicator member formed of soft washable material;

a second layer of said applicator member attached to said first layer, said second layer comprising a soft material face suitable for applying skin-absorbing substances to the skin of a body and, at least in part, a non-absorbent face oriented toward said first layer;

a middle portion positioned between said first layer and said second layer to provide cushioning therebetween;

elongated elasticized straps secured to each said opposing end of said applicator member; and a handle secured to each of said elongated elasticized straps and spaced from said applicator member.

2. The device of claim 1 wherein said middle portion is an enclosed void filled with batting.

3. The device of claim 1 wherein said middle portion is an enclosed void containing a fluid.

4. The device of claim 1 wherein said second layer of said applicator member is further formed with an absorbent face positioned adjacent said non-absorbent face, said absorbent face providing a contact surface for placement against a body.

5. The device of claim 4 wherein said second layer of said applicator member is formed from a material comprising an absorbent surface integrally formed with a non-absorbent surface.

6. The device of claim 5 wherein said non-absorbent surface of said second layer is also water repellent.

7. The device of claim 1 wherein said second layer of said applicator member is formed from a first sub-layer of non-absorbent material and a separate, attached second sub-layer of absorbent material.

8. The device of claim 7 wherein said first sub-layer is also water repellent.

9. The device of claim 7 wherein the attachment of said second sub-layer to said first sub-layer provides a pocket sized to receive an substance for application to a body.

10. The device of claim 9 wherein said substance for application to a body is contained within a prepackaged packet sized to be received in said pocket.

11. The device of claim 9 further comprising a packet sized to be received in said pocket of said applicator member, said packet containing said substance and having a plurality of holes formed in said packet to dispense said substance therethrough to said absorbent second sub-layer.

12. The device of claim 1 wherein said second layer is further structured with a securement structure for attachment thereto of an applicator pad, said applicator pad further comprising an absorbent layer of material and securement structure for attaching said applicator pad to said second layer of said applicator member.

13. The device of claim 1 wherein said elongated elasticized straps further comprise a covering of washable material.

14. The device of claim 1 wherein said first layer of said applicator member is formed of a material having a roughened surface suitable for use in exfoliating skin from the body.

15. A device for applying substances to difficult-to-reach places of a human body, comprising:

a washable applicator member of defined thickness sized for application of skin-absorbing substances to large and hard-to-reach portions of a body, comprising;

a first layer formed of soft, washable material;

a second layer attached to said first layer comprising an absorbent face of material suitable for applying skin-absorbing substances to the skin and a non-absorbent face oriented toward said first layer;

a middle portion positioned between said first layer and said second layer filled with a cushioning material to provide cushioning therebetween;

two elongated elasticized straps each secured to said applicator member at substantially opposing orientation to each other; and a handle secured to each of said elongated elasticized straps and spaced from said applicator member.

16. The device of claim 15 wherein said middle portion is an enclosed void filled with batting.

17. The device of claim 15 further comprising an applicator pad detachably attachable to said second layer of said applicator member, said applicator pad providing a contact surface for applying a substance to a body.

* * * * *